United States Patent [19]

Sano

[11] Patent Number: 4,892,610

[45] Date of Patent: Jan. 9, 1990

[54] AUTO REEL LOADER

[75] Inventor: Shozo Sano, Hyogo, Japan

[73] Assignee: Kabushiki Kaisha Kaneda Kikai Seisakusho, Osaka, Japan

[21] Appl. No.: 303,210

[22] Filed: Jan. 30, 1989

[30] Foreign Application Priority Data

Sep. 6, 1988 [JP] Japan ..... 63-223100

[51] Int. Cl.[4] ..... B66F 9/14

[52] U.S. Cl. ..... 156/446; 156/457; 156/458; 156/522; 242/58.6

[58] Field of Search ..... 242/58, 58.6, 79; 156/187, 577, 184, 357, 446, 456–458, 523, 522

[56] References Cited

U.S. PATENT DOCUMENTS

| | | | |
|---|---|---|---|
| 3,690,583 | 9/1972 | Herman | 242/79 X |
| 4,131,206 | 12/1978 | Kawada | 242/58.6 X |
| 4,757,951 | 7/1988 | Ludszeweit | 242/79 X |
| 4,828,199 | 5/1989 | Annacker | 242/58.6 X |

*Primary Examiner*—David Simmons

*Attorney, Agent, or Firm*—Griffin, Branigan, & Butler

[57] ABSTRACT

An auto reel loader includes a plate onto which a truck is moved and a used-up paper roll holder. The used-up paper roll holder takes a used-up paper roll off a paper roll reel of a rotary press and transfers the used-up roll paper to the truck. The used-up paper roll holder has a tape holding roller which can be moved between an operating position where the tape holding roller is pressed against the circumferential outer surface of the used-up paper roll and a non-operating position where the paper holding roller is positioned apart from the circumferential outer surface of the used-up paper roll, an unrollable adhesive tape whose leading end juxtaposes the tape holding roller and can be stuck to the circumferential outer surface of the used-up paper roll by pressing the tape holding roller against the circumferential outer surface of the used-up paper roll, and a cutter which, when the tape holding roller has been retracted to a non-operating position, can cut off a part of the adhesive tape extending from the tape holding roller to the circumferential outer surface of the used-up paper roll. When the used-up paper roll is rotated by the paper roll reel, with the tape holding roller taking the operating position, the adhesive tape is wound around the circumferential outer surface of the used-up paper roll, thereby fastening the remaining strip of paper on the used-up paper roll. Thereafter, the adhesive tape is cut off by a cutter and is prepared for the next round of the fastening operation.

5 Claims, 14 Drawing Sheets

AUTO REEL LOADER

FIELD OF THE INVENTION

The present invention relates to an auto reel loader which can automatically perform the steps of taking a used-up paper roll off a paper roll reel of a rotary press, loading a new, not yet used, paper roll onto the paper roll reel and carrying away the used-up paper roll which has been taken off the paper roll reel.

PRIOR ART

A conventional auto reel loader is disclosed in Japanese patent publication Nos. 5638496 and 60-30622. As disclosed on these publications, an auto reel loader includes a plate onto which is loaded a truck carrying a new, not yet used, paper roll. The auto reel loader also includes a used-up paper roll holder which takes a used-up paper roll off the paper roll reel of a rotary press and transfers the used-up paper roll onto the truck. When the truck has been mounted on the plate, the auto reel loader moves toward the reel and stops when the used-up paper roll holder has been positioned right under the used-up paper roll. Next, the used-up paper roll is released from the reel and drops onto the used-up paper roll holder. The new, not yet used, paper roll is loaded onto the reel. The used-up paper roll holder is lowered, and tilted in the direction of the truck so that the used-up paper roll tumbles down under the pull of gravity from the used-up paper roll holder onto the truck. The plate on which the truck is mounted is lowered and the used-up paper roll is carried away from the auto reel loader by the truck.

Since the used-up paper still has some strip of paper (hereinafter referred to as the remaining strip of paper) left unused, the prior art auto reel loader frequently experiences problems in that the rolled remaining strip of paper sometimes gets loosened and unrolled when the used-up paper roll is tumbling from the used-up paper roll holder to the truck. As a result, the unrolled remaining strip of paper sometimes dangles from the truck and masks a collision-preventing sensor provided on the truck, thereby causing the collision preventing sensor to malfunction. The malfunctioning of the sensor not only hinders the normal work of the auto reel loader, but sometimes dangerously results in an unexpected runaway of the truck. Further, if the remaining strip of paper is left unrolled, the work of disposing of the used-up paper roll, for example, unloading the used-up paper roll from the truck and carrying the used-up paper roll to a dumping site, becomes troublesome and cannot be done efficiently.

SUMMARY OF THE INVENTION

An object of the present invention is to provide an auto reel loader which can prevent the remaining strip of paper on a used-up paper roll from dangling during removal and disposal of the roll.

An object of the invention is to provide an auto reel loader including a plate onto which a truck is moved and a used up paper roll holder for receiving a used-up paper roll from the reel of a rotary press and transferring it to the truck, the auto reel loader having a fastening device for securing the remaining strip of paper on a used up paper roll while the roll is still supported by the reel. The fastening device winds an adhesive tape around the circumferential outer surface of the used-up paper roll while it is supported by the reel so that the remaining strip of paper is fastened to the roll thereby preventing loosening and unrolling of the remaining strip of paper. According to a preferred embodiment of the invention, the fastening device comprises a tape holding roller which can be moved between an operating position where the tape holding roller is pressed against the circumferential outer surface of the used-up paper roll, and a non-operating position where the paper holding roller is positioned apart from the circumferential outer surface of the used-up paper roll, an unrollable adhesive tape whose leading end juxtaposes the tape holding roller and can be stuck to the circumferential outer surface of the used-up paper roll by pressing the tape holding roller against the circumferential outer surface of the used-up paper roll, and a cutter which, when the tape holding roller has been retracted to the non-operating position, can cut off a part of the adhesive tape extending from the tape holding roller to the circumferential outer surface of the used-up paper roll. When the used-up paper roll is rotated by the paper roll reel while the tape holding roller is in its operating position, the adhesive tape is wound around the circumferential outer surface of the used-up paper roll, thereby fastening the remaining strip of paper on the used-up paper roll. The adhesive tape is then cut by a cutter and is prepared for the next round of the fastening operation.

An object of the invention is to provide an auto reel loader as described above wherein the used-up paper roll holder is provided with a plurality of rollers which can be rotatably pressed against the circumferential outer surface of the used-up paper roll while it is on the paper roll reel so that as the used-up paper roll is rotated on the reel, the remaining strip of paper is tightly rolled up.

A further object of the invention is to provide an auto reel loader as described above wherein the used-up paper roll holder is provided with a device which can push and jolt the used-up paper roll off the reel to insure that it is removed from the reel.

Another object of the invention is to provide an auto reel loader as described above wherein the truck is provided with a stopper which can limit movement of the used-up paper roll as it is falls from the used-up paper roll holder to the truck so that the used-up paper roll never falls off.

Other objects of the invention and its mode of operation will become apparent upon consideration of the following description and the accompanying drawing.

DESCRIPTION OF THE PREFERRED EMBODIMENT

Figure 4:
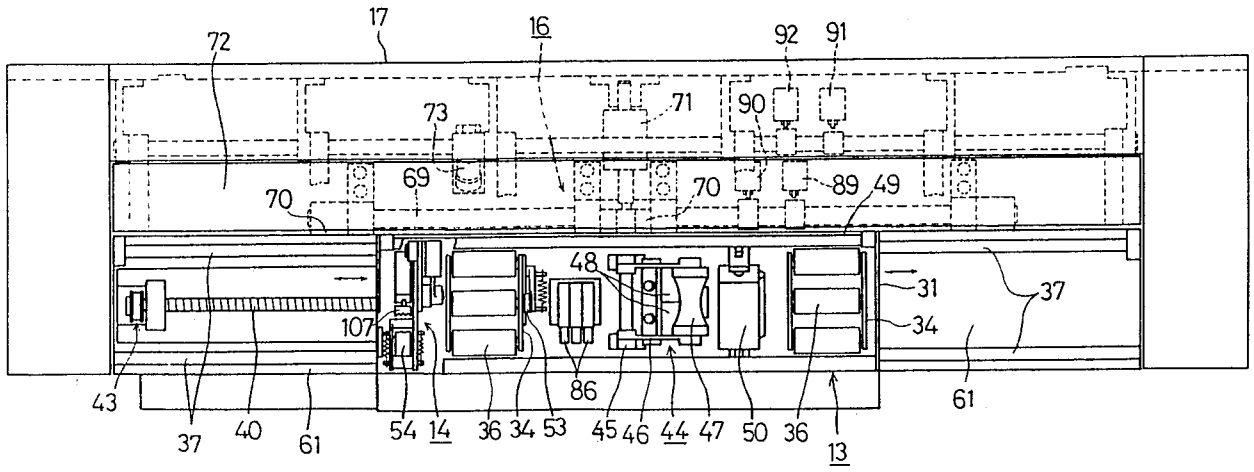
FIG. 4 is a sectional plan view of the used-up paper roll holder, the plate on which a truck is loaded, and the elevating device.
Figure 5:
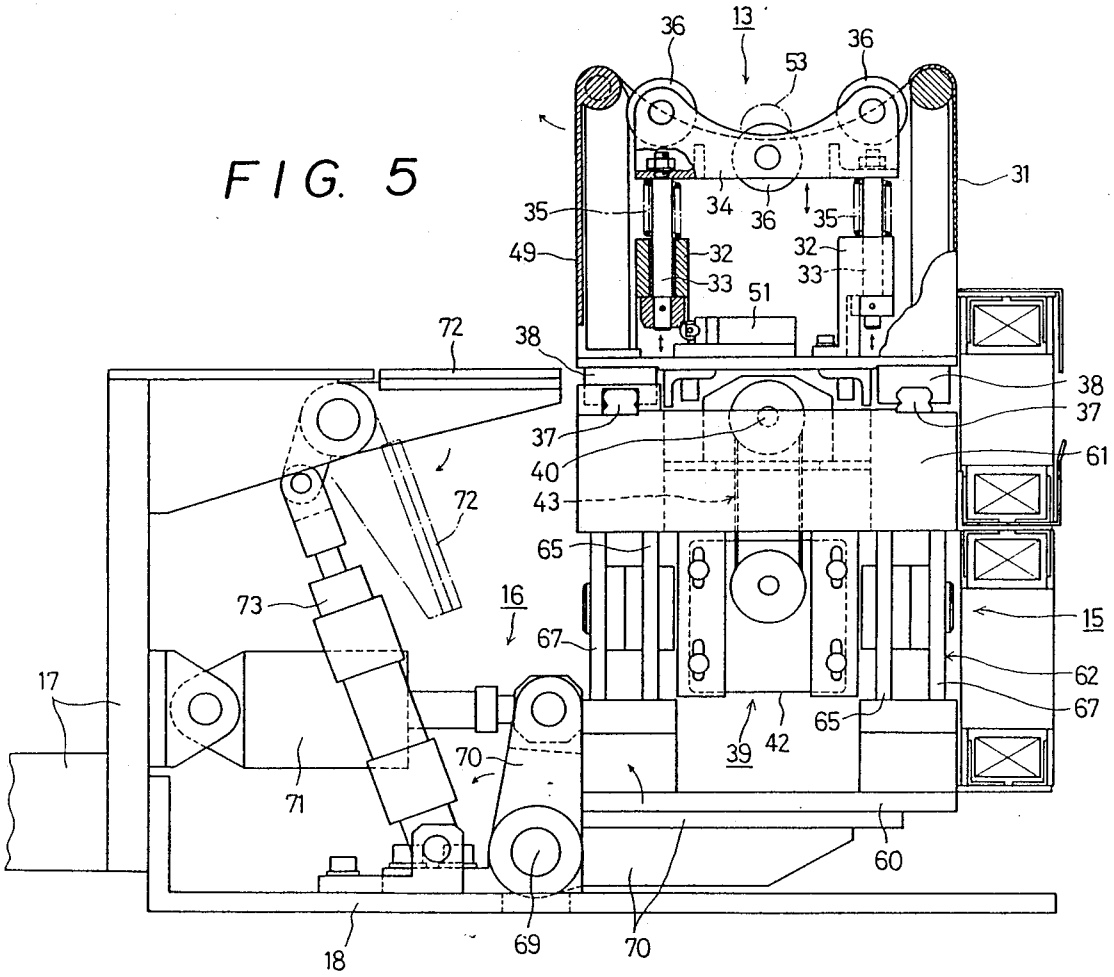
FIG. 5 is a partially cutaway, enlarged front view of the used-up paper roll holder, the elevating device and the tilting device.
Figure 6:
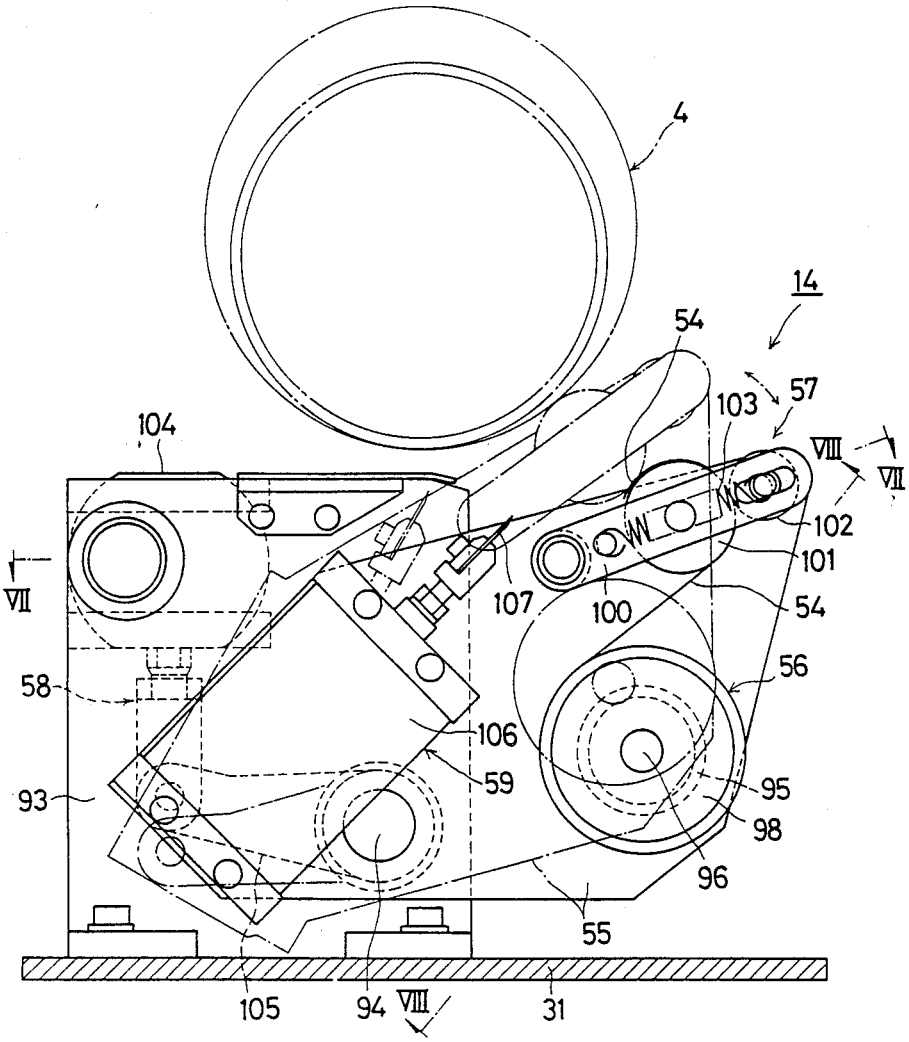
FIG. 6 is a front view of the fastening device.

FIGS. 1–6 illustrate an auto reel loader according to a preferred embodiment of the present invention. As shown in FIG. 6, the auto reel loader is so structured that a paper roll carrying truck 3, which has brought a new (i.e. not yet used) paper roll 2 from a storage site, is mounted near the paper roll reel 1 of a rotary press so that the truck 3 can load the paper roll 2 onto the reel 1 after a used-up paper roll 4 is taken off the reel. The auto reel loader itself can move along rails 5 (FIG. 3) which run at a right angle relative to a reel axis. The truck 3 may be an automatically movable, electrically driven truck of conventional design.

Figure 7:
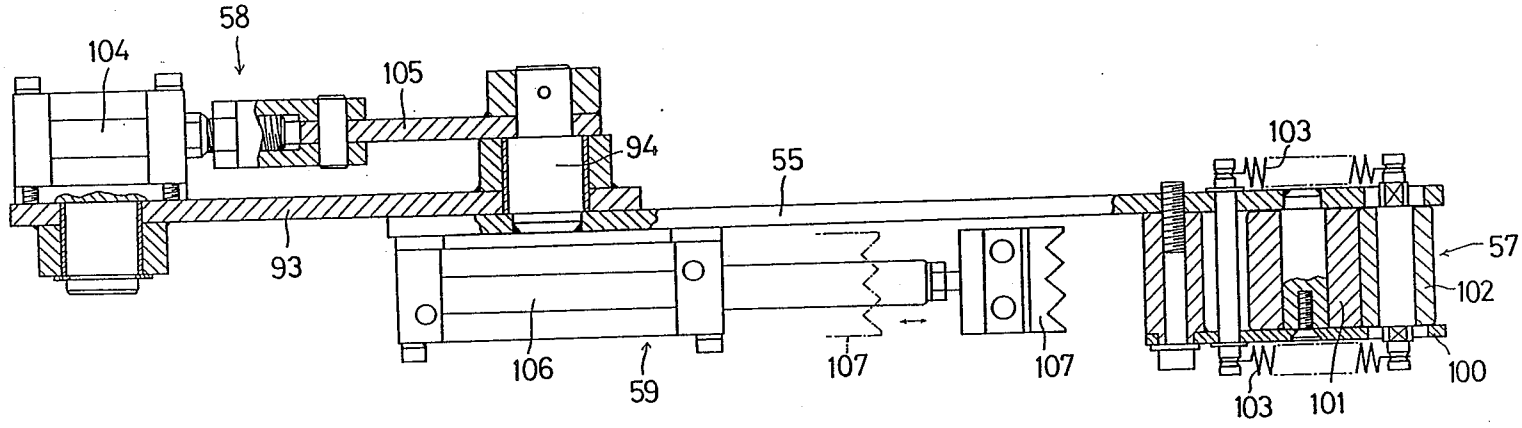
FIG. 7 is a sectional view of the fastening device taken along the line VII—VII in FIG. 6.

As shown in FIGS. 6 and 7, the paper roll reel 1 comprises a reel axis 6 loaded on a Y-shaped frame (not shown) standing on the floor, trifurcated arms 7 provided at the both ends of the reel axis 6, and support axes 8, 8' which are rotatably mounted on the ends of the respective arms 7. The support axis 8 can be retracted by a hydraulic cylinder 9 in the direction parallel to the reel axis 6. When the support axis 8 is retracted the used-up paper roll 4 can be taken off the reel 1 and a new paper roll 2 loaded thereon. The support axis 8' can be rotated by a motor 10 in the direction which enables the used-up paper roll 4 to roll up a strip of paper remaining on the roll.

Figure 1:
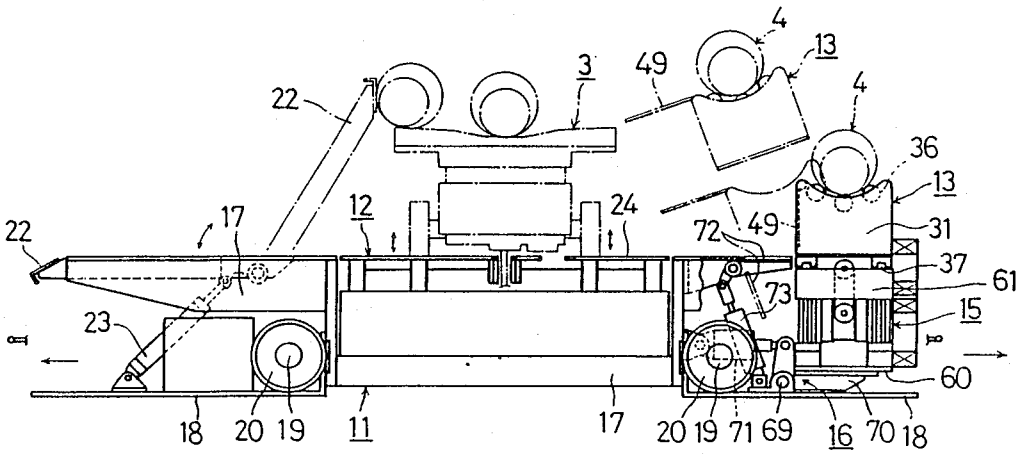
FIG. 1 is a partially cutaway front view of the auto reel loader of the present invention.

As shown in FIG. 1, the auto reel loader comprises an automatically movable carriage 11, a truck elevating device 12 provided in the center of the carriage 11, a used-up paper roll holder 13 positioned at an end of the carriage 11, a fastening device 14 (FIG. 2) installed on the holder 13, a device 15 for elevating the holder 13, and a device 16 for tilting the holder 13.

Figure 2:
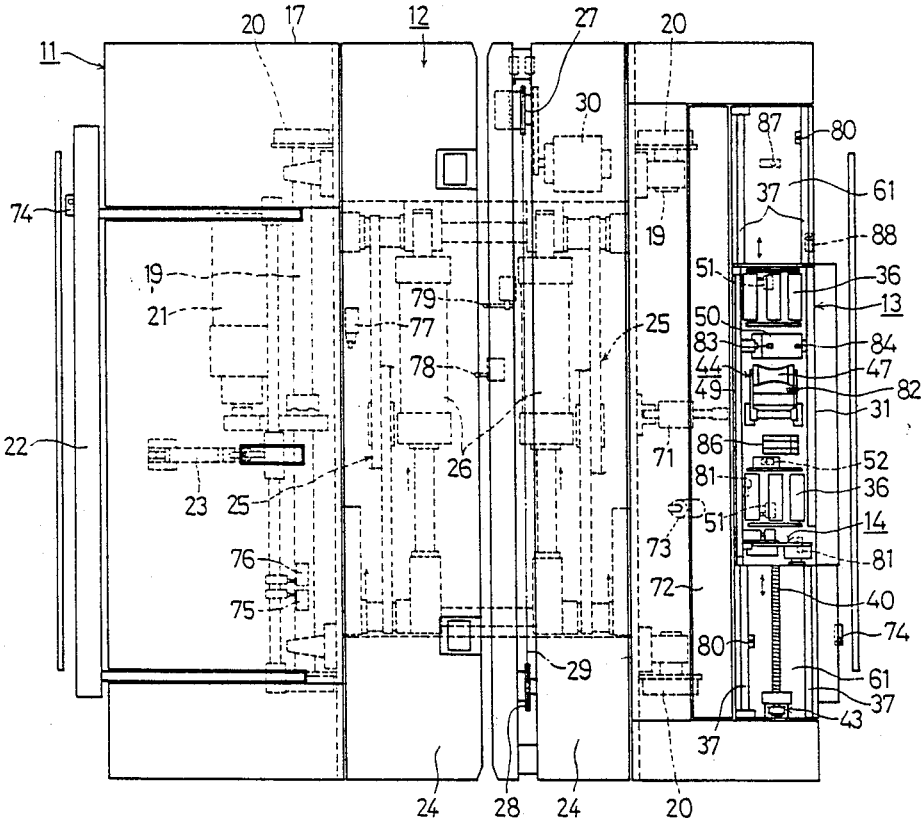
FIG. 2 is a partially cutaway plan view of the auto reel loader.

The carriage 11 comprises, as illustrated in FIGS. 1 and 2, a main frame 17, a lower frame 18 secured to the forward and rearward portions of the lower part of the main frame 17, axles 19 rotatably installed on the main frame 17, wheels 20 mounted on the axles 19, and a motor 21 which is connected to the axles 19 via a transmission gear or the like. The carriage 11 can move along the rails 5 running at a right angle relative to the reel axis 6.

The carriage 11 is provided with a stopper 22 which serves to prevent a used-up paper roll 4 from falling off the truck 3 when transferring the used-up paper roll 4 from the used-paper roll holder 13 to the truck 3. The stopper 22 can be pivoted, as shown in FIG. 1, in accordance with extension and retraction of a hydraulic cylinder 23.

The truck elevating device 12, on which the truck 3 carrying the new paper roll 2 can be mounted, can lift the truck 3 for loading the new paper roll 2 onto the reel 1. The truck elevating device 12 comprises a plate 24 which can be at the same level as the floor to facilitate the loading of the truck 3 onto the plate, links 25 which are of pantograph structure and installed between the plate 24 and the main frame 17, and a hydraulic cylinder 26 which is installed between the main frame 17 and the links 25. In accordance with extension and retraction of the hydraulic cylinder 26, the plate 24 is corresponding lifted and lowered by action of the links 25. By loading the truck 3, which is carrying the new paper roll 2 onto plate 24 and then lifting the plate 24 up close to the reel 1, the new paper roll 2 is ready to be loaded onto the reel 1.

The plate 24 is provided with a hauling device which is disclosed in Japanese patent publication No. 56-38496. This hauling device can automatically haul the truck 3, which has run up to the vicinity of the reel 1 onto the plate 24. The hauling device can also automatically take the truck 3 off the plate 24. The hauling device comprises actuated and nonactuated sprockets 27 and 28, a chain 29 with hooks intended to hook the truck 3, and a motor 30.

Figure 3:
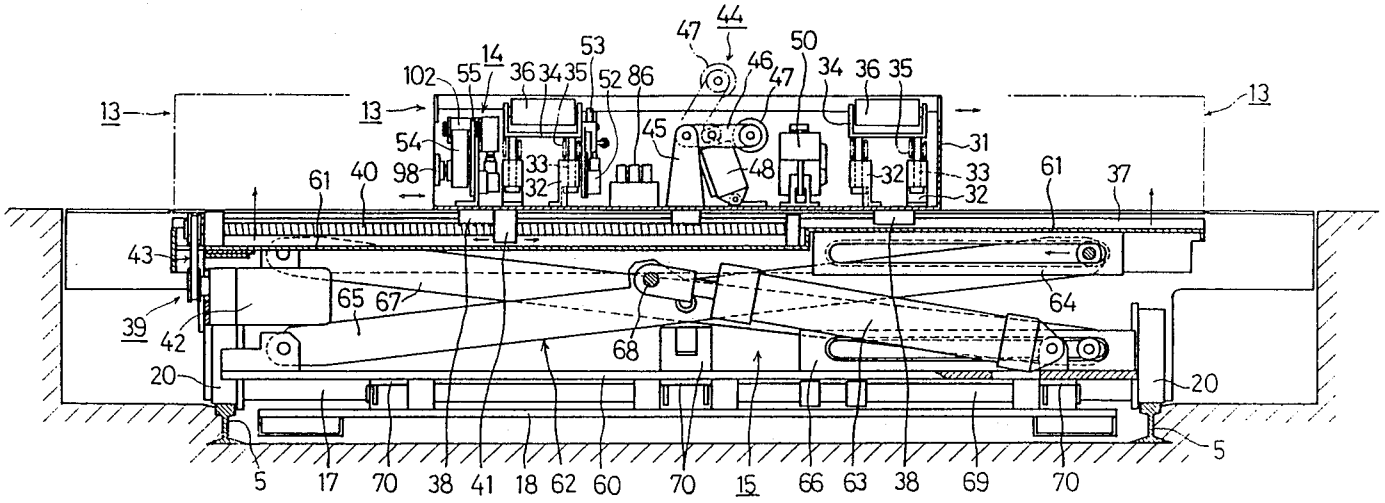
FIG. 3 is a vertical, sectional side view of the used-up paper roll holder, the plate on which a truck is loaded, and the elevating device for lifting the used-up paper roll holder.

The used-up paper roll holder 13 is installed on the carriage 11 and is positioned adjacent the reel 1. The holder 13 can be elevated by an elevating device 15 and tilted by a tilting device 16. The holder 13 is designed to tightly roll a strip of paper remaining on the used-up paper roll 4 and can take the tightly rolled used-up paper roll 4 off of the reel 1 and hold it. The used-up paper roll holder 13 comprises, as shown in FIGS. 3–5, a case 31 with the upper side opened, a plurality of support pillars 32 which are vertically installed inside the case 31 and positioned at both ends of the bottom wall thereof, a pair of support cases 34 which are supported by the support pillars 32 via support axes 33 and are vertically movable, springs 35 which are installed between the support pillar 32 and support case 34 and are always pressing the support case 34 upwardly, and a plurality of rollers 36 which are rotatably supported by each case 34 and can be positioned in contact relation with the used-up paper roll 4 on the reel 1. The used-up paper roll 4 can be rotated in the direction which allows the used-up paper roll 4 to roll up the strip of paper remaining on the used-up paper roll 4 while the rollers 36 are being pressed against the used-up paper roll 4 by lifting the used-up paper roll holder 13 with the elevating device 15 to be explained below. As a result, the strip of paper remaining on the used-up paper roll 4 can be tightly rolled up.

The used-up paper roll holder 13 is secured onto an upper support 61 of the elevating device 15 in such a manner that the holder 13 can be moved in the direction parallel to the reel axis 6. More specifically, the used-up paper roll holder 13 is slidably mounted on the sliders 38 placed on guide rails 37 which are in turn mounted on the upper support 61 and run in the direction parallel to the reel axis 6. The holder 13 can be moved slidingly on the sliders 38 by a driving apparatus 39. The driving apparatus 39 comprises a rotatable screw axle 40 which runs in the direction parallel to the guide rails 37, a female screw 41 which is secured to the underside of the case 31 and engaged with the screw axle 40, a motor 42 which is installed under the upper support 61, and a belt 43 which links the output shaft of the motor 42 and the screw axle 40. Clockwise or counter clockwise rotation of the motor 42 results in the corresponding rotation of the axle 40, which in turn leads to reciprocating movement of the female screw 41 along the screw axle 40. As a result, the holder 13, which is secured to the female screw 41, travels along the guide rails 37.

The used-up paper roll holder 13 has a device 44 which, when the used-up paper roll 4 is taken off the reel 1 and dropped, i.e., when one of the axis 8' has been retracted for releasing the used-up paper roll 4, pushes the used-up paper roll 4 in order to insure that the used-up paper roll 4 drops from reel 1 when it is released by movement of axis 8'. The pushing device 44 comprises, as shown in FIGS. 3 and 4, an arm 46 which is pivotably mounted on the support 45 on the case 31, a pushing roller 47 mounted on the arm 46 for pushing the used-up paper roll 4 while it is on the reel 1, and a hydraulic cylinder 48 which actuates the arm 46. Extension and retraction of the hydraulic cylinder 48 results in upward and downward movement of the arm 46 with the result that the roller 47 pushes and jolts the used-up paper roll 4 free of reel 1.

The used-up paper roll holder 13 is provided with a bridging plate 49 which can be pivoted and bridge the gap between the holder 13 and the truck 3, thereby serving to transfer a used-up paper roll 4 which has been dropped on the holder 13 from the holder onto the truck 3. When the used-up paper roll holder 13 is lifted and tilted in the direction of the truck 3, the bridging plate 49 is pivoted upwardly by the hydraulic cylinder 50 so that the plate 49 may bridge the gap between the holder 13 and the truck 3. The used-up paper roll holder 13 is provided with a limit switch 51 (FIG. 5) which detects that the rollers 36 have been pressed against the used-up paper roll 4 on the reel 1 and further a limit switch 52 (FIG. 3) which detects that the used-up paper roll 4 has been dropped on the rollers 36. When the rollers 36 have been pressed against the used-up paper roll 4 on the reel 1 and, as a result, the support case 34 and the support axes 33 have been pushed down with a force which overcomes the upward pressing force of the springs 35, the limit switch 51 is actuated. The limit switch 52 is actuated when the used-up paper roll 4 has dropped and rests on a detecting roller 53.

Figure 8:
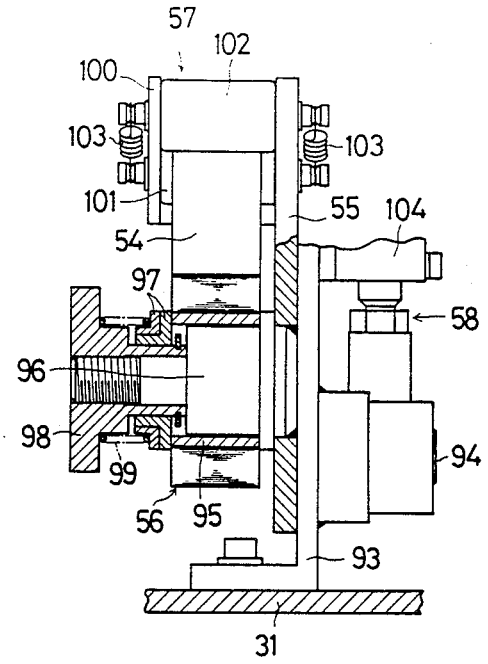
FIG. 8 is a sectional view of the fastening device taken along the line VIII—VIII in FIG. 6.

The fastening device 14 fastens the remaining strip of paper on the used-up paper roll 4 by winding an adhesive tape 54 around it. The fastening device 14 comprises, as shown in FIGS. 6 to 8, a swingable plate 55, a tape member 56, a tape holder 57, a plate actuating device 58 and a cutter 59. The swingable plate 55 is pivotably linked by a pin 94 to a support plate 93 which is mounted upright on an end of the case 31. The tape member 56, the tape holder 57 and the cutter 59 are supported by plate 55.

The tape member 56 comprises a core tube 95 and the adhesive tape 54 which has an adhesive layer on one side and is wound around the core tube 95. The tape member 56 is rotatably and removably loaded on a tape pin 96 which has a portion of larger diameter and a portion of smaller diameter and is secured to the swingable plate 55. That is to say, the tape member 56 is rotatably loaded on the portion of larger diameter of the tape pin 96 and is secured by a knob 98 which has a pressing tube 97. The knob 98 has a threaded inner opening which is removably engaged with an externally threaded portion of smaller diameter of the tape pin 96 (FIG. 8). The pressing tube 97 of the knob 98 is always pressed against the tape member 56 by a compression spring 99. Hence, regardless of the width of the tape member 56, the tape member 56 is rotatably fixed on the tape pin 96. The pressing force of the compression spring 99 is chosen so that it does not hinder smooth rotation of the tape member 56.

The tape holder 57 holds the leading end of the adhesive tape 54 in such a manner that the adhesive layer side of the adhesive tape 54 faces the used-up paper roll 4 on the reel 1. The tape holder 57 comprises, as shown in FIGS. 6 and 7, a roller holding plate 100 placed substantially parallel to an upper portion of the swingable plate 55, a tape holding roller 101 rotatably held between the swingable plate 55 and the roller holding plate 100 with its circumferential outer surface protruding above the upper side of the swingable plate 55, a tape pressing roller 102 rotatably held between the swingable plate 55 and the roller holding plate 100 and capable of being positioned in contact relation with the circumferential outer surface of the tape holding roller 101, and an extension spring 103 pulling the tape pressing roller 102 toward the tape holding roller 101 to keep the two rollers 101, 102 in contact relation. When the leading end of the adhesive tape 54 is pulled through between the tape holding roller 101 and the tape pressing roller 102 and is trained along the tape holding roller 101, the adhesive tape 54 is held between the tape holding roller 101 and the tape pressing roller 101 with the adhesive layer side of its leading end facing the used-up paper roll 4 on the reel 1. The pulling force of the extension spring 103 is chosen so that it does not hinder the smooth discharge of the adhesive tape 54.

The plate actuating device 58 swings the swingable plate 55 in the upward direction so that the circumferential outer surface of the tape holding roller 101 may contact the rolled-up remaining strip of paper on the used-up paper roll 4. The plate actuating device 58 comprises a hydraulic cylinder 104 pivotably fastened to the support plate 93 and an arm 105 connecting the piston rod of the hydraulic cylinder 104 and the pin 94. When the hydraulic cylinder 104 is activated from the retracted state to the extended state, the swingable plate 55 moves from the position shown in solid line to he position shown in broken line (FIG. 6) with the result that the roller 101 moves to the operating position from the non-operating position. As a result, the leading end of the adhesive tape 54 held by the tape holder 57 is stuck to the used-up paper roll 4.

When the adhesive tape 54 has been wound around the used-up paper roll 4, as subsequently described, the cutter 59 operates to cut off the adhesive tape 54 at a point between the used-up paper roll 4 and the tape holding roller 101. The cutter 59 comprises a hydraulic cylinder 106 secured to the swingable plate 55 and a cutter blade 107 attached to the end of the piston rod of the hydraulic cylinder 106.

The adhesive tape winding device 14, when not operating to stick the adhesive tape 54 around the used-up paper roll 4, holds the leading end of the adhesive tape 54, with the hydraulic cylinders 104, 106 being in the retracted position.

When the remaining strip of paper on the used-up paper roll 4 has been rolled-up, the hydraulic cylinder 104 is extended to move the swingable plate 55 from the position shown in solid line in FIG. 6 to the position shown in broken line. As a result, the tape holding roller 101 is positioned in contact relation with the used-up paper roll 4, thereby making the leading end of the adhesive tape 54 stick to the used-up paper roll 4.

When the leading end of the adhesive tape 54 has been stuck to the used-up paper roll 4, rotation of the used-up paper roll 4 by the motor 10 results in pulling and, as a result, the unrolling of the adhesive tape 54 and then sticking the adhesive tape 54 onto the circumferential outer surface of the used-up paper roll 4.

When the adhesive tape 54 has been wound around the used-up paper roll 4 once or several times, the rotation of the paper roll 4 is stopped. The hydraulic cylinder 104 is then retracted and the swingable plate 55 drops.

Figure 13:
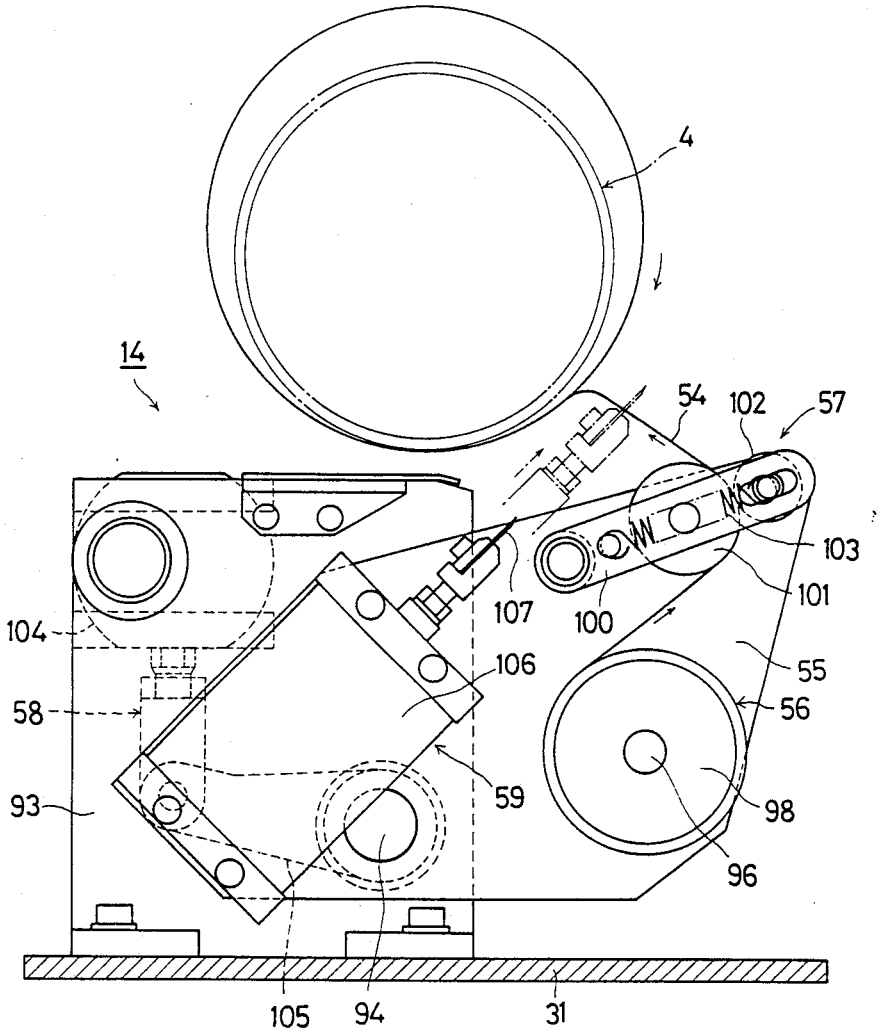
FIG. 13 is a sectional front view of the fastening device showing the fastening operation.

Thereafter, the cutter 59 operates and cuts off the adhesive tape 54 as shown in FIG. 13. The adhesive tape 54 is cut off at a position between the used-up paper roll 4 and the tape holding roller 101. As a result, the leading end of the adhesive tape 54 is trained along the circumferential outer surface of the tape holding roller 101 with the adhesive layer side of its leading end facing outside, i.e., facing the used-up paper roll 4. This makes the leading end of the adhesive tape 54 ready for the next round of the adhesive tape winding operation.

The elevating device 15 for elevating the used-up paper roll holder 13 to a required height comprises, as shown in FIG. 3, a lower support 60 mounted on a tilting device 16 (FIG. 4) an upper support 61 positioned above the lower support 60, links 62 of a pantograph structure installed between the lower support 60 and the upper support 61, and a hydraulic cylinder 63 installed between the lower support 60 and the links 62 for lifting the upper support 61.

The links 62 comprise a pair of inner link bars 65 whose respective one end is pivotably connected to the lower support 60 and whose respective other end is in turn slidably engaged with a corresponding elongate perforation on an upper guide plate 64 secured to the upper support 61. A pair of outer link bars 67 are pivotably connected to the middle portion of a pair of the inner link bars 65 respectively, and have one end which is pivotably connected to the upper support 61. The other end is engaged with a corresponding elongate perforation on a lower guide plate 66 secured to the lower support 60. A pin 68 bridges one inner link bar 65 to the other inner link bar 65 and pin 68 is connected to the piston rod of the hydraulic cylinder 63. Consequently, when the hydraulic cylinder 63 is extended and retracted, the link bars 65 and 67 are stretched upwardly and flattened correspondingly, thereby elevating or lowering the upper support 61 so that the used-up paper roll holder 13 on the upper support 61 is elevated or lowered.

The tilting device 16 can tilt the used-up paper roll holder 13 together with the elevating device 15 in the direction of the truck 3. The tilting device 16 comprises, as shown in FIGS. 3 and 5, a horizontal axle 69 rotatably mounted on the lower frame 18, a plurality of supports 70 mounted on the horizontal axle 69 and upholding the lower support 60, and a hydraulic cylinder 71 positioned between the support 70 located in the center and the main frame 17. When the hydraulic cylinder 71 is retracted from the position shown in FIG. 5, the supports 70 are pivoted on the horizontal axle 69 so that the used-up paper roll holder 13 is tilted from the position illustrated in FIG. 1, in solid line to the position illustrated in broken line.

With reference to FIGS. 1, 2 and 4, numeral 72 designates a stepping plate which can be pivoted downwardly for avoiding collision with the used-up paper roll holder 13 when the used-up paper roll holder 13 is tilted. A hydraulic cylinder 73 actuates the stepping plate 72 to pivot. Limit switches 74 insure safe travel of the auto reel loader in the forward and backward directions. A limit switch 75 serves to limit pivoting of the stopper 22 by to required angle and further limit switch 76 serves to limit the return of the stopper 22. Another limit switch 77 is actuated to stop the lowering of plate 24 at the lower limit position while limit switch 78 is actuated to stop the lifting of the plate 24 at the upper limit position. A limit switch 79 is provided to stop the truck 3 at the desired position after the truck 3 has boarded the carriage 11. A limit switches 80 are actuated to stop the sliding travel of the used-up paper roll holder 13 at the required end positions. Limit switch 81 is actuated to stop the sliding travel of the holder 13 at the central position. A sensor 82 serves to stop elevation of the rollers 36 at the upper limit position. Sensor 83 serves to stop the rising bridging plate 49 at the required position while a sensor 84 serves to stop the dropping bridging plate 49 at the original upright position. A limit switch 81 serves to stop used-up paper roll holder 13 at the lower limit position while a limit switch 88 is actuated to stop the rising used-up paper roll holder 13 at the upper limit position. A limit switch 89 is actuated to stop the pivoting used-up paper roll holder 13 at the required tilted position. Limit switch 90 is actuated to stop the returning used-up paper roll holder 13 at the original upright position. Limit switch 91 is actuated to stop the stepping plate 72 at the pivoted, tilted position, and a limit switch 92 is actuated to stop the returning stepping plate 72 at the original horizontal position.

The auto reel loader operates as follows. The used-up paper roll holder 13 is moved along the rails 37 for a desired distance in proportion with the length of the new paper roll 2 so that the holder 13 is positioned opposite the new paper roll 2.

Figure 9:
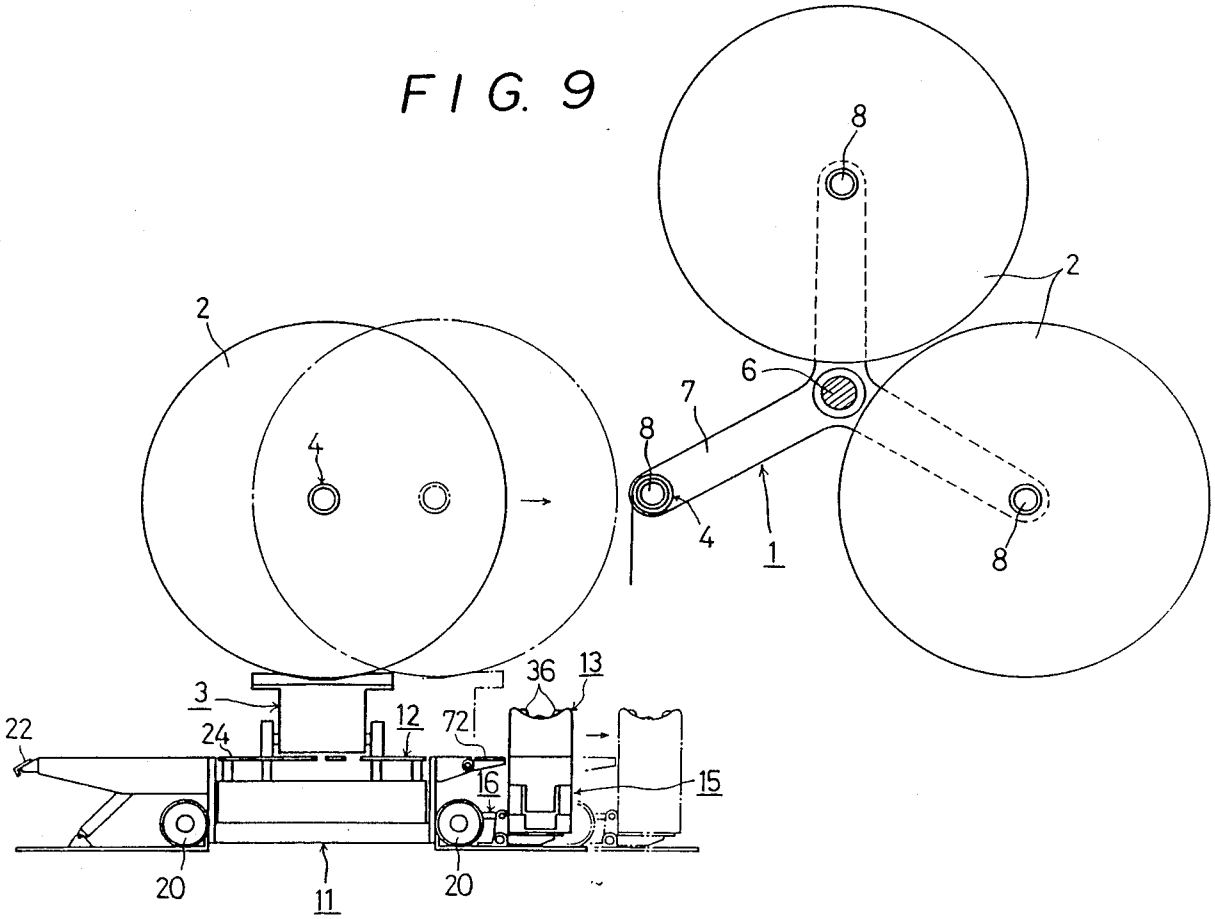
FIG. 9 is a sketchy front view of the auto reel loader carrying the truck thereon and moving up to the reel.
Figure 10:
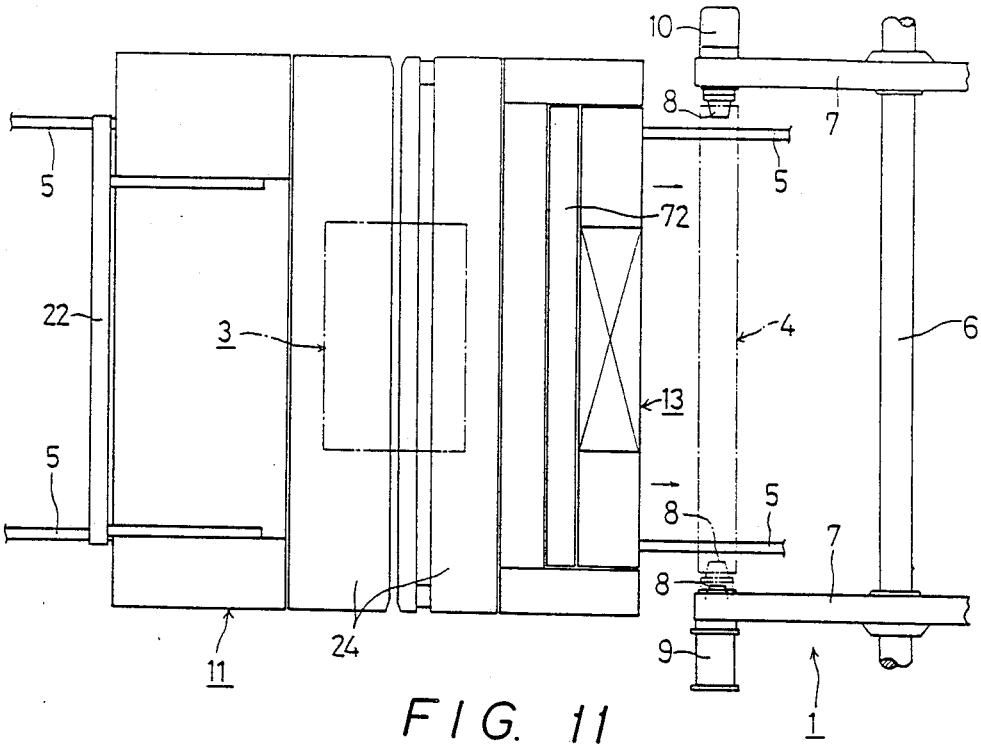
FIG. 10 is a sketchy plan view of the auto reel loader carrying the truck thereon and moving up to the reel

The truck 3 loaded with a new paper roll 2 moves to the vicinity of the reel 1. Momentum allows the truck to mount the plate 24. The truck 3 is then hauled into a desired place on the plate 24 by the hauling device (not shown) and is stopped (FIGS. 9 and 10).

When the truck 3 has been loaded onto plate 24, the auto reel loader travels in the direction of the reel 1 and stops when the used-up paper roll holder 13 has been positioned right under the used-up paper roll 4. This position is illustrated by the broken line in FIG. 9.

Figure 12:
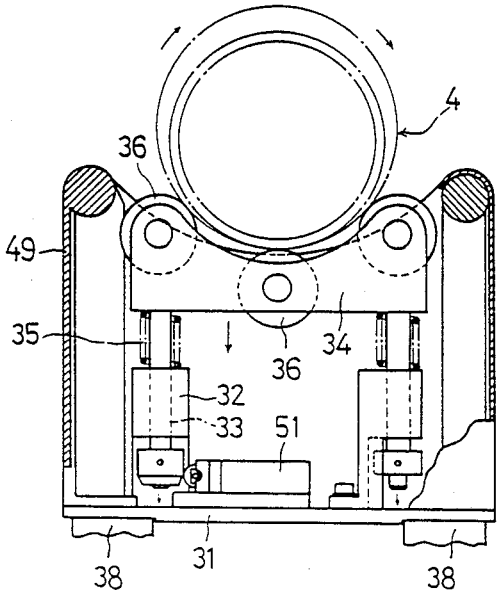
FIG. 12 is a partially cutaway front view of a main portion of the used-up paper roll holder winding the remaining strip of paper tightly.
Figure 11:
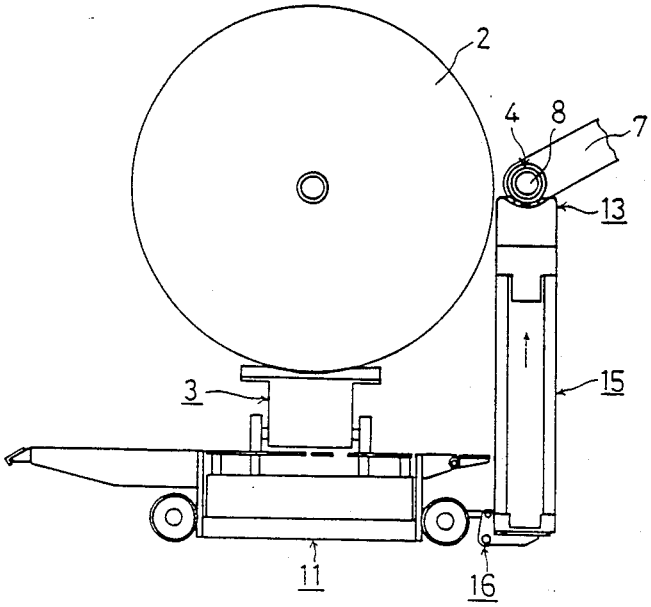
FIG. 11 is a sketchy front view of the used-up paper roll holder being lifted, with the rollers being rotatably pressed against the used-up paper roll.

The used-up paper roll holder 13 is then lifted by the elevating device 15 and, as a result, the rollers 36 are pressed against the outer surface of the used-up paper roll 4 while the used-up paper roll is rotated by the motor 10 (FIG. 7) in a direction which allows the used-up paper roll 4 to roll up the remaining strip of paper (FIGS. 11 and 12). As a result, the remaining strip of paper is tightly rolled up.

Figure 14:
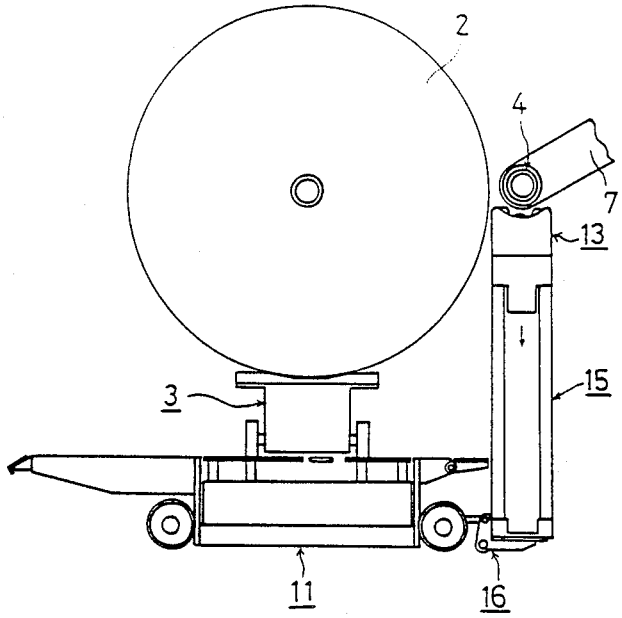
FIG. 14 is a sketch front view of the auto reel loader showing the used-up paper roll being ready to be received by the used-up paper roll holder.

When the remaining strip of paper has been rolled up, the fastening device 14 operates to fasten of the remaining strip of paper (FIG. 13). When the remaining strip of paper has been fastened, the used-up paper roll holder 13 is lowered slightly by the elevating device 15 (FIG. 14) and the support axis 8 of the reel 1 is retracted by the hydraulic cylinder 9. As a result, the used-up paper roll 4 which has lost support drops onto the rollers 36 of the used-up paper roll holder 13, as illustrated by the broken line in FIG. 15. After the support axis 8 of the reel 1 has been retracted, the device 44 raises the pushing roller 47 to push and jolt the used-up paper roll 4 on the support axis 8 with the result that the used-up paper roll is sure to fall onto the used-up paper roll holder 13.

Figure 15:
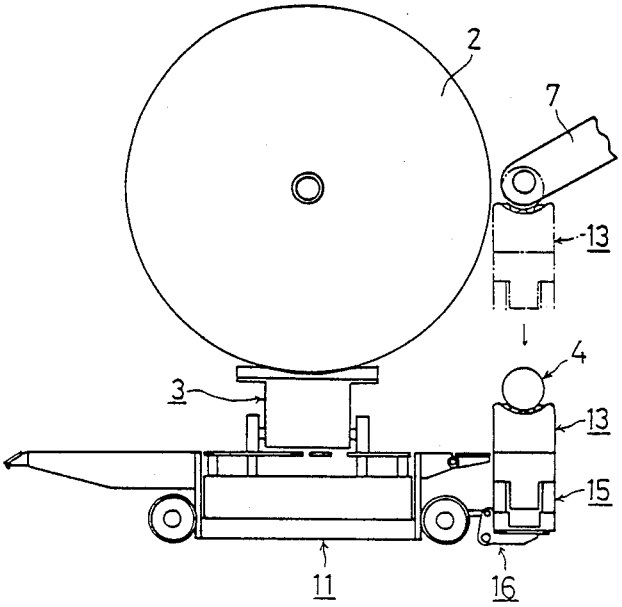
FIG. 15 is a sketchy front view of the auto reel loader showing the used-up paper roll having been received by the used-up paper roll holder.
Figure 16:
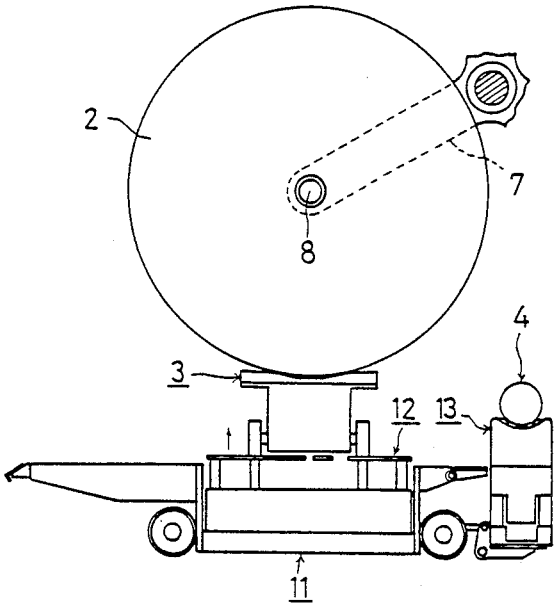
FIG. 16 is a sketchy front view of the auto real loader showing the new paper roll having been loaded on the reel.

When the used-up paper roll 4 has been dropped onto the used paper roll holder 13, the used-up paper roll holder 13 is lowered to the original position. The auto reel loader, in turn, further moves in the direction of the reel 1, elevates by the truck elevating device 12 the truck 3 together with the new paper roll 2 placed thereon, and then stops raising the truck 3 when the new paper roll 2 and the support axis 8 have become coaxial (FIGS. 15 and 16). The support axis 8 is then advanced by the hydraulic cylinder 9 and inserted into the cylindrical core opening of the new paper roll 2. In this manner, loading of the new paper roll 2 on the reel 1 is completed.

Figure 17:
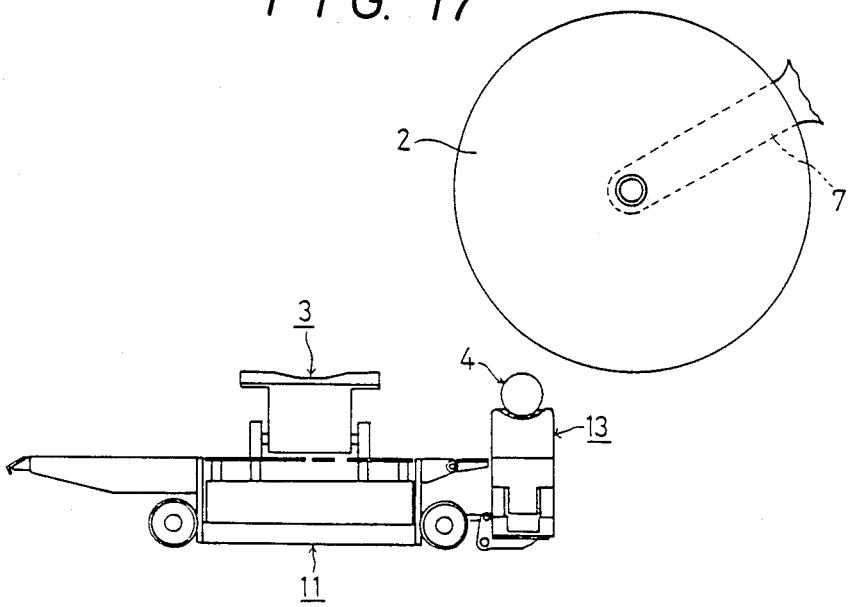
FIG. 17 is a sketchy front view of the auto reel loader moved backward from the reel; and, FIG. 18 is a sketchy front view of the auto reel loader showing transfer of the used-up paper roll from the used-up paper roll holder to the truck.

When the loading of the new paper roll 2 has been completed, the truck 3 is lowered down to the original position and the auto reel loader returns to the original position (FIG. 17).

Figure 18:
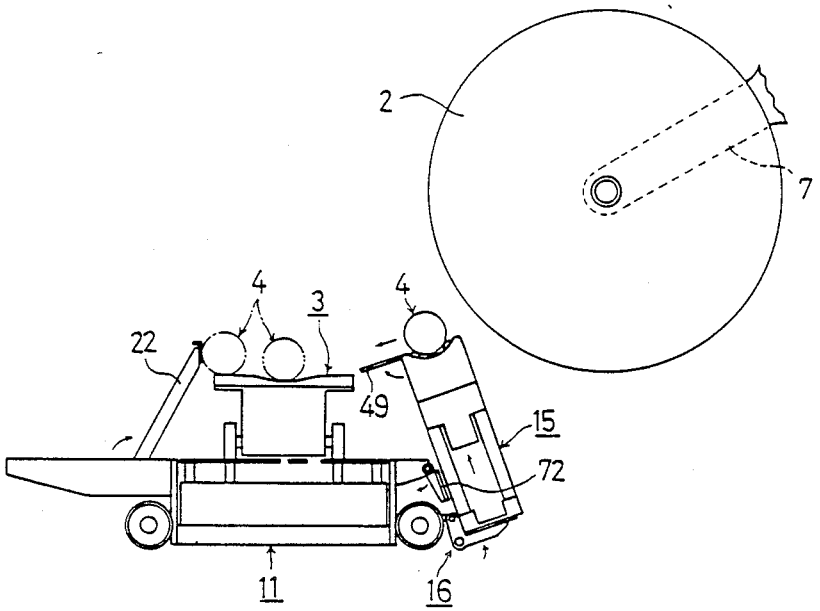

After the auto reel loader has returned to the original position, the stepping plate 72 is pivoted downward, and at the same time the used-up paper roll holder 13 is tilted together with the elevating device 15 in the direction of the truck 3 by the tilting device 16 and further is lifted by the elevating device 15. Thereafter, the bridging plate 49 is pivoted upwardly to bridge between the used-up paper roll holder 13 and the truck 3, and the pushing device 44 is operated again so that the pushing roller 47 can push the used-up paper roll 4 off the used-up paper roll holder 13. As a result, the used-up paper roll 4 is pushed off and tumbles down the bridging plate 49, and falls onto the truck 3 (FIG. 18). The used-paper roll 4 which has tumbled down the bridging plate 49 does not fall off the truck 3 but is stopped and rests thereon due to the stopper 22 which is placed in the upright state near the truck 3, thereby insuring the transfer of the used-up paper roll 4 from the used-up paper roll holder 13 to the truck 3.

When the used-up paper roll 4 has been transferred to the truck 3, the used-up paper roll holder 13, the stopper 22, and other elements return to their respective original positions. The truck 3 with the used-up paper roll 4 mounted thereon moves off the plate 24 and carries away the used-up paper roll 4 to a predetermined place.

Although, according to the foregoing embodiment of the invention, the used-up paper roll holder 13 is installed on one side alone of the auto reel loader, it is possible to provide such a holder on both sides of the auto reel loader. This arrangement must be used when reels 1 of the rotary press are provided on both sides of the auto reel loader.

Although, according to the foregoing embodiment, the used-up paper roll holder 13 is movable in the direction parallel to the reel axis 6, it can be immovably fixed to the upper support 61. Further, the used-up paper roll holder 13 need not be tilted together with the elevating device 15 in the direction of the truck 3. The used-up paper roll holder 13 can be structured in such a manner that it alone can be tilted, without tilting the elevating device 15.

Although the fastening device 14 of the described embodiment is mounted near one end of the used-up paper roll holder 13 so that the adhesive tape 54 is wound around one end of the used-up paper roll 4, a second similar fastening device may be provided for winding adhesive tape around the opposite end of the roll 4. Alternatively a single fastening device may be used to apply adhesive tape around both ends of a used-up paper roll. This may be accomplished by applying the adhesive tape to one end of a paper roll 4, moving the used-up paper roll holder 13, and then apply adhesive tape to the other end of the paper roll.

From the foregoing description it is evident that various modifications and substitutions may be made in the preferred embodiment without departing from the spirit of the invention. It is intended therefore to be limited only by the scope of the appended claims.

The embodiments of the invention in which an exclusive property or privilege is claimed are defined as follows.

I claim:

1. An auto reel loader having a plate on which a truck may be loaded and a used up paper roll holder for receiving a used up paper roll from the paper roll reel of a rotary press and transferring the used-up paper roll to the truck, said auto reel loader being characterized in that it is provided with a fastening means which may be moved into proximity of said paper roll reel, said fastening means including means for applying an adhesive tape to the outer circumferential surface of a used-up paper roll on the paper roll reel to thereby secure a remaining strip of paper on the used-up paper roll.

2. An auto reel loader as claimed in claim 1 wherein said fastening means comprises a tape holding roller movable between an operating position where the tape holding roller is pressed against the circumferential outer surface of the used-up paper roll and a non-operating position where the tape holding roller is positioned apart from the circumferential outer surface of the used-up paper roll, an unrollable adhesive tape whose leading end juxtaposes the tape holding roller and can be stuck to the circumferential outer surface of the used-up paper roll by pressing the tape holding roller against the circumferential outer surface of the used-up paper roll and a cutter which, when the tape holding roller has been retracted to a non-operating position, cuts off a part of the adhesive tape extending from the tape holding roller to the circumferential outer surface of the used-up paper roll.

3. An auto reel loader as claimed in claim 1 wherein said used up paper roll holder includes a plurality of rollers and means for rotatably pressing said rollers against the used-up paper roll while said used-up paper roll is on said paper roll reel.

4. An auto reel loader as claimed in claim 1 wherein said used-up paper roll holder includes a device for pushing the used-up paper roll to thereby aid the removal of the used-up paper roll from said paper roll reel.

5. An auto reel loader as claimed in claim 1 wherein gravity assists in transferring said used-up paper roll from the used-up paper roll holder to the truck and said auto reel loader includes a stopper for preventing the used-up paper rolls from falling off the truck as it is transferred.

* * * * *